US008317538B2

(12) United States Patent
Carle et al.

(10) Patent No.: US 8,317,538 B2
(45) Date of Patent: Nov. 27, 2012

(54) TERMINATED PLUG CONNECTOR FOR ANTENNA EQUIPMENT

(75) Inventors: Michael Carle, Heilbronn (DE); Jörg Zenkner, Forchtenberg (DE)

(73) Assignee: Amphenol-Tuchel Electronics GmbH

( * ) Notice: Subject to any disclaimer, the term of this patent is extended or adjusted under 35 U.S.C. 154(b) by 600 days.

(21) Appl. No.: 12/089,493

(22) PCT Filed: Oct. 6, 2006

(86) PCT No.: PCT/EP2006/009686

§ 371 (c)(1),
(2), (4) Date: Feb. 12, 2010

(87) PCT Pub. No.: WO2007/042218

PCT Pub. Date: Apr. 19, 2007

(65) Prior Publication Data

US 2010/0130046 A1 May 27, 2010

(30) Foreign Application Priority Data

Oct. 7, 2005 (DE) ..... 10 2005 048 248

(51) Int. Cl.
*H01R 13/73* (2006.01)

(52) U.S. Cl. ..... 439/548; 439/620.13; 439/620.21

(58) Field of Classification Search ..... 439/320, 439/271, 548–551, 555, 556, 560–565, 701, 439/620.01, 620.08, 620.09, 620.13, 620.21, 439/620.3
See application file for complete search history.

(56) References Cited

U.S. PATENT DOCUMENTS

| | | | | |
|---|---|---|---|---|
| 5,484,298 | A | 1/1996 | Flum et al. | |
| 7,165,987 | B2 * | 1/2007 | Kim et al. | 439/271 |
| 7,344,414 | B2 * | 3/2008 | Kuo | 439/620.04 |
| 2004/0014363 | A1 | 1/2004 | Khemakhem et al. | |
| 2010/0190375 | A1 * | 7/2010 | Rohde | 439/549 |

OTHER PUBLICATIONS

International Search Report, mailed May 4, 2007.

* cited by examiner

*Primary Examiner* — Tulsidas C Patel
*Assistant Examiner* — Travis Chambers
(74) *Attorney, Agent, or Firm* — Blank Rome LLP

(57) ABSTRACT

Disclosed is a terminating connector comprising a terminating connector housing, fastening means that are embodied monolithically with the connector housing and are used for fixing the terminating connector to a socket, and an insulating member which is rotatably mounted in the terminating connector housing and is used for retaining contact elements that can engage with corresponding contact elements in a socket insulating member.

15 Claims, 3 Drawing Sheets

TERMINATED PLUG CONNECTOR FOR ANTENNA EQUIPMENT

Figure 1:
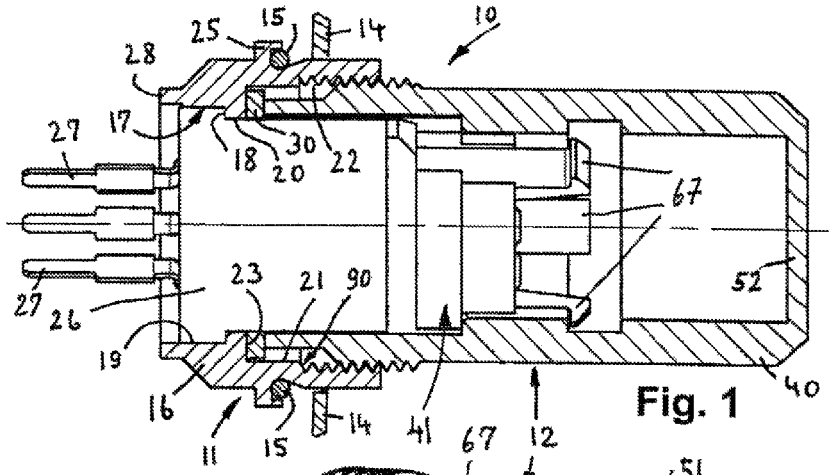

This application is a National Phase of PCT/EP2006/009686 filed 6 Oct. 2006, which claims priority to DE 10 2005 048 248.1 filed 7 Oct. 2005, which is hereby incorporated by reference.

The invention relates to a terminated connector in particular for antenna equipment. Generally, the invention relates to a connection formed by a first connector and a second connector. The invention further relates to a first connector and a second connector being designed such that a reduction in cost is achieved.

To create a connection the respectively designed first and second connectors are brought into engagement such that they are inserted into each other. For a simplification of the description it will be assumed, that the first connector is a connector which is mounted into a piece of equipment and will generally be referred to as a jack or female connector. This connection is frequently used for antenna equipment. Further, the second connector is designed as a plug connector adapted to be inserted into said female or jack connector. In the field of antennas, the plug connector is frequently called a terminated plug connector inasmuch as it frequently contains an electronic circuit, for instance a resistor, to provide the antenna equipment with the proper level of impedance.

For plug connections in general and also in particular for the connector technique used with antennas, a separate locking nut mounted on the terminated plug connector used; said locking nut is, for instance, rotatably mounted on the terminated plug connector and is screwed onto a part of the female connector. This screw connection is in general, achieved after the terminated plug connector is properly inserted into an insulating body of the female connector with a coding rib being provided on the insulating body of the terminated plug connector such that during the screwing movement of the locking nut onto the female connector the correct position of the female connector and the terminated plug connector is maintained.

So as to provide for a reduction in cost and to simplify such a connection the invention provides that the terminated plug connector comprises a connector housing which is provided at its front end, as seen in the plug direction, a threading. Said threading can be brought into a threading engagement with an opposite threading provided at the female connector. Further, the insulating body of the terminated plug connector is rotatably mounted within the terminated plug connector housing.

In accordance with the present invention it is possible to obtain, in particular due to a threaded locking, a sealed connector. The insulating body of the terminated plug connector is received independently of the position in the housing of the terminated plug connector. The housing of the terminated plug connector is preferable a single piece. The threading is preferably provided in the form of an outer threading formed integrally at the plug connector housing. Due to the freely rotatable positioning of the insulating body in the housing of the terminated plug connector and due to the coding rib at the insulating body, the locking of the housing is possible without using a separate locking nut and thus a single piece terminated plug connector housing is achieved.

In accordance with the invention, the housing of the terminated connector is provided directly with the threading providing a locking means. Further, the insulating body of the terminated connector comprises detent hooks, which come into engagement with a groove in the housing of the terminated connector so that the insulating body of the terminated connector is free to rotate about the axis of the housing of the terminated connector. Thus, the housing of the terminated connector can be of a single piece design without requiring a locking nut. The axial rotatability of the insulating body of the terminated connector in the terminated connector housing combines the function of providing a housing with the locking means.

Figure 2:
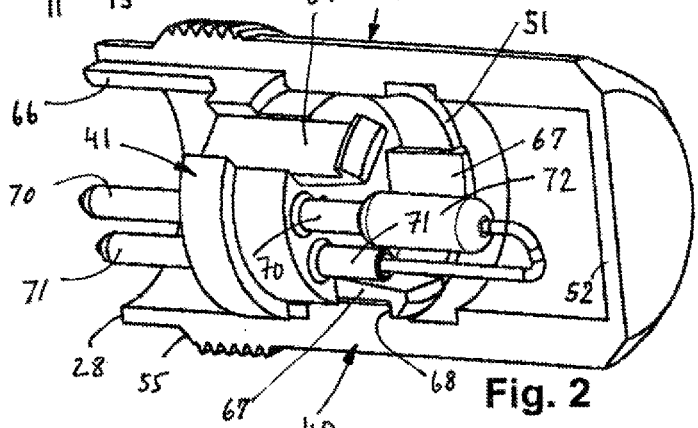
Figure 3:
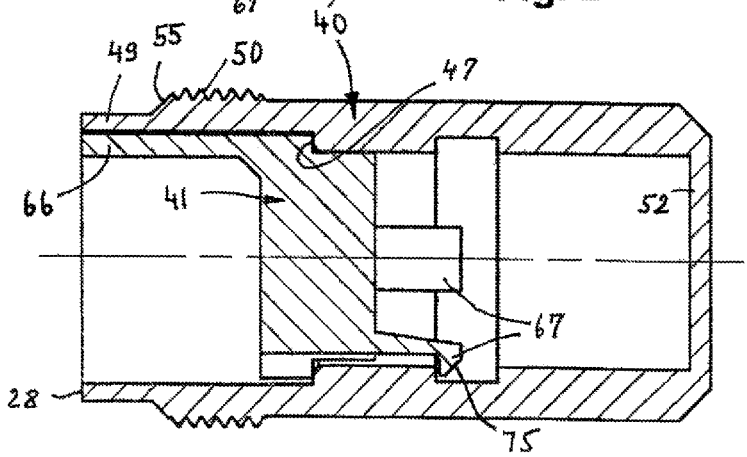
Figure 4:
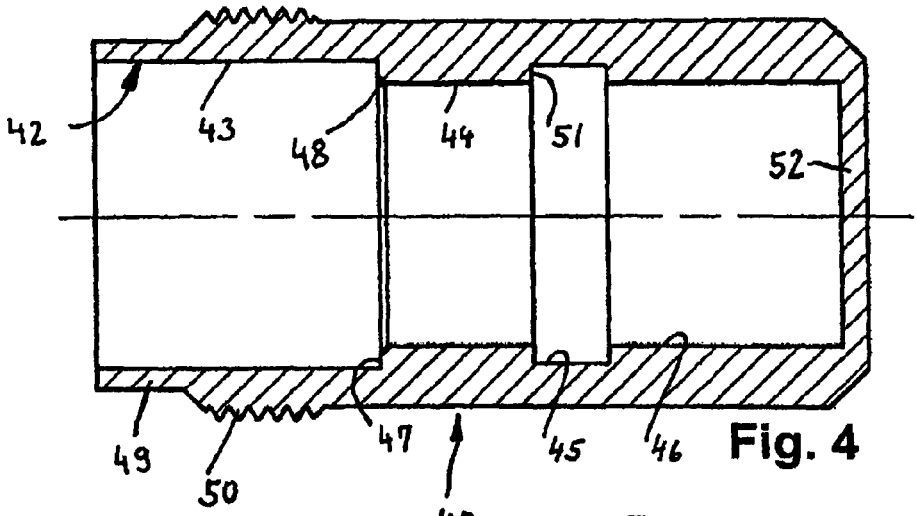
Figure 5:
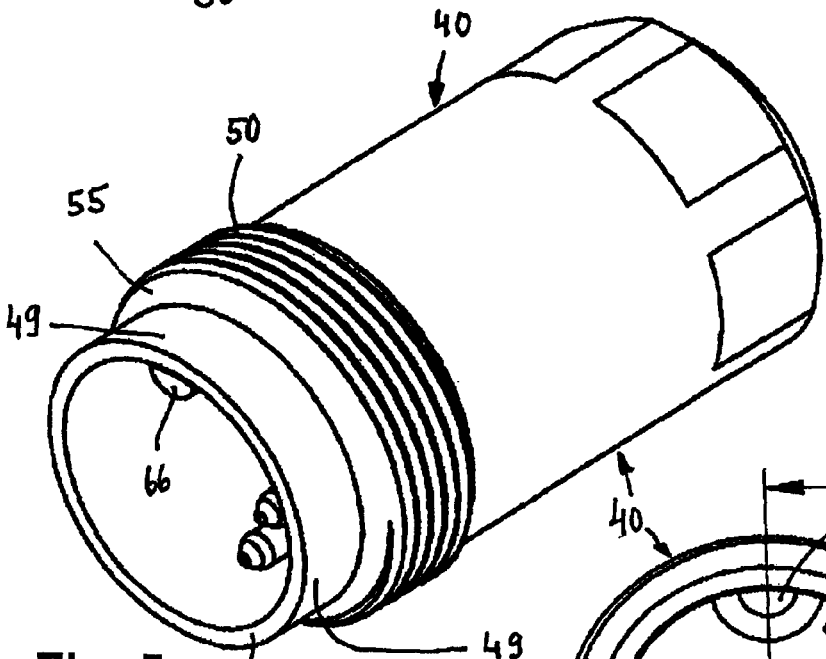
Figure 6:
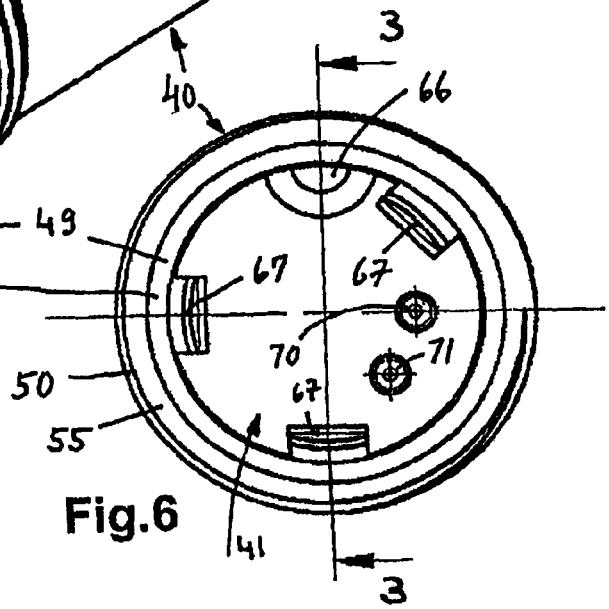
Figure 7:
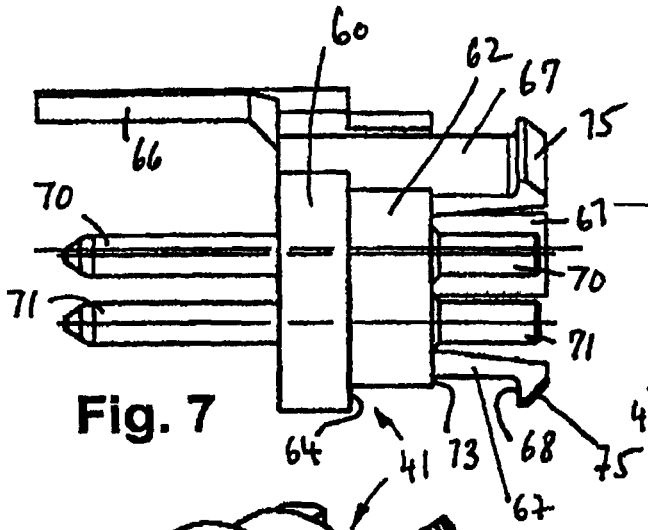
Figure 8:
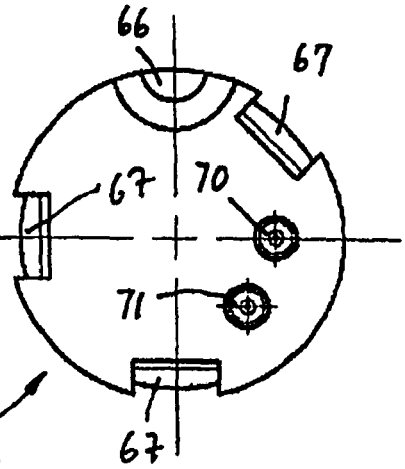
Figure 9:
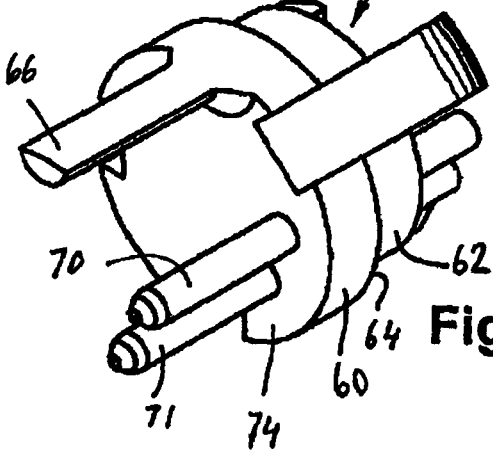

Further advantages, objects and details of the invention can be gathered from the description of an embodiment as shown in the drawings. The drawings disclosed in:

FIG. 1 an axial sectional view of a connection comprising a first connector and a second connector i.e. a female connector fixed to a housing and a terminated plug connector;

FIG. 2 the plug connector of FIG. 1 in a schematic perspective sectional view without the female connector;

FIG. 3 an axial sectional view along line 3-3 in FIG. 6 of the connector of FIG. 2;

FIG. 4 an axial sectional view of the housing of the terminated connector of FIGS. 1 through 3;

FIG. 5 a perspective view of the terminated connector of FIGS. 1 through 3;

FIG. 6 a schematic frontal view of the terminated connector of FIG. 5;

FIG. 7 details of FIGS. 1 through 3 i.e., an insulating body of the terminated plug connector with prong contacts being inserted therein;

FIG. 8 a view of the insulating body of FIG. 7 from the left hand side; and FIG. 9 a perspective view of the insulating body of FIG. 7

FIG. 1 shows a sectional view of a connection 10; said connection 10 comprising a first connector 11 and a second connector 12. The first connector 11 can be referred to as an opposite connector, or as an equipment connector, or simply as an opposite member. However, in the following description the first connector will be referred to as a female, or jack, connector 11; this term should not be interpreted in a limiting sense.

The second connector is, in this embodiment, designed as a plug connector adapted to cooperate with the female connector. In the following description the second connector will be referred to as terminated plug connector 12. The female connector 11 is shown in FIG. 1 in a position adjacent to a wall 14 of a piece of equipment. This wall 14 of a piece of equipment can be present in any kind of equipment. Inasmuch as, in this case a terminated antenna connector is described, the piece of equipment would be a piece of equipment used in the process of connecting antennas. The female connector 11 comprises a female connector housing 16. At the outer circumference of the female connector housing 16 a seal 15 is provided. At the time when the housing 16 is mounted to the equipment wall 14, the seal 15 will come into abutment with the equipment wall 14 thus providing a sealing effect. The seal 15 sits in an annular projection 25 of the housing 16.

The housing 16 comprises an opening 17 extending there through and being open at both ends. In the opening 17 an annular abutment surface 18 is formed which extends radially. The annular abutment surface 18 is formed due to the fact, that the opening 17 is comprised of different sections, i.e. an opening section 19 having a middle diameter, an opening section 20 with a smaller diameter and an opening section 21 with a larger diameter. Adjacent to the opening section 21 a threading section 22 is formed. In addition to the annular abutment surface 18 an annular abutment surface 23 is formed between the annular section 20 and the annular section 21. The annular abutment surface 23 extends in a radial direction and a sealing ring 30 is in abutment with the annular surface 18.

The female connector 11 comprises within its housing 16 an insulator, i.e., a female connector insulator body 26 which comprises sections extending in an axial direction and having different diameters. From a left section having a larger diameter and being located on the left-hand side in FIG. 1, contact elements 27 project out of the insulating body 26. The left section is in abutment with the annular abutment surface 18 such that the distance of insertion of the insulating body 26 into the housing 16 is limited. The section adjacent to the left section has a smaller diameter and is partially in abutment with its circumference at the opening section 20. The section with the smaller diameter extends into an longitudinally extending area which is formed by sections 21 and 22 having a larger diameter. The section having a smaller diameter ends approximately with the same axial distance with the end of the housing 16 shown at the right-hand side in FIG. 1. As is shown in FIG. 2 the terminated connector 12 partially extend into an annular space 90 which is formed by the section of the insulating body 26 having a smaller diameter and the opening sections 21 and 22. Into the opening section 22 an inner threading is cut which is, for reasons of simplicity also referred to by the reference number 22.

The Terminated Plug Connector 12

The terminated plug connector 12 comprises in substance a terminated plug connector housing 40 and a terminated plug connector insulating body 41 as is shown in FIGS. 1 through 9.

The terminated plug connector housing 40 is preferably a single piece as is shown in FIG. 4 and comprises a longitudinally extending opening 42, which is terminated by a wall 52. The opening 42 forms a plurality of opening sections having different longitudinal lengths and different diameters. The opening 42 comprises an (opening) section 43 having the largest diameter, adjacent thereto is an (opening) section 44 having a smaller diameter and again adjacent to the (opening) section 44 an (opening) section 45 having a larger diameter. Adjacent to the (opening) section 45 is an (opening) section 46 having the same diameter as the (opening) section 44. The (opening) section 46 is terminated by the wall 52. The (opening) sections 43 and 44 have different diameters to form an abutment surface 47 and adjacent thereto a beveled edge 48 is provided. Further, the (opening) section 45, which could as be referred to as a groove, forms a holding surface or detent surface 51. The longitudinal wall forming the housing 40 comprises, as is shown in FIG. 4 different wall thicknesses and forms at the open end of the housing 40 a reduced diameter section 49. Adjacent to the section 49 a threading 50 with a larger diameter is provided. In the area of the threading 50 the wall thickness is larger than in the smaller diameter section 49. Between the section 49 and the threading a bevel 55 is provided.

The terminated plug connector insulating body 41 comprises, as is shown in FIGS. 7 through 9, an inner section 60 on the plug side as well as adjacent thereto a terminating side annular section 62 with a somewhat smaller diameter than the diameter of the annular section 62. Between the two annular sections 60 and 62 an abutment surface 64 is formed which extends radially with respect to the longitudinal axis of the insulating body 41. As is, for instance, shown in FIG. 3 the abutment surface 64 is in abutment with the abutment surface 47 of the housing 40. Further, integral with the annular section 60 a coding rib or a coding bar 66 is formed with the annular section 60 and projects away from the circumference of the ring section 60 in axial direction. Three detent arms 67 project in the opposite direction beyond the frontal surface of the insulating body 41; said frontal surface being referred to by reference sign 73 in FIG. 7.

Further, two contact prongs 70, 71 are inserted into recesses of the insulating to body 41. The connecting ends of the contact prongs 70, 71 project beyond the frontal surface 73; the ends of the contact prongs 70, 71 which are adapted to cooperate with the female connector 11 project beyond a frontal surface 74 (see FIG. 9) similar to the coding rib 66.

FIG. 2 also discloses that a termination circuit 72 is connected to the contact prongs 70, 71. The termination circuit 72 can be for instance a termination resistor.

As can be in FIGS. 1, 2, 3 and 6, the insulating body 41 can be inserted into the housing 40. The outer circumferential surfaces of the annular section 60 and the annular section 62 slide during insertion along the respective (opening) sections 43 and 44 thus providing precise guidance. At the beginning of the insertion of the insulating body 41 into the housing 40 the inclined edges 75 of the detent hooks 67 abut or engage the beveled edge 48 and thus the detent hooks 67 are resiliently bent inwardly until they come into engagement with the annular groove 45 with the consequence that the detent surfaces 68 of the detent hooks 67 press on the holding or detent surface 51 of the housing 40. Also, in this condition the annular abutment surface 64 of the insulating body 41 is in abutment with the abutment surface 47. The precise dimensions are selected such that the insulating body 41 is held in axial direction in the housing 40 but is rotatably supported.

For mounting the terminated plug connector 12 to the female connector 11, the terminated plug connector 12 is, as already mentioned, inserted into the annular space formed by the female connector 11. In this process, the coding rib 66 is brought into alignment with a respective opening in the insulating body 26 and is partially inserted. Subsequently, the housing 40 is rotated until a sealing surface 28 formed by the frontal edge of the housing 40 presses with sufficient tightness against the sealing ring 30 due to the screw motion. While rotating the terminating connector housing 40 the insulation body 41 remains in the position selected by the coding rib 66. The insulating body 41 will be further inserted when rotating of the housing 40, inasmuch as the housing 40 can be rotated with respect to the insulating body 41.

Both the housing 16 and the housing 40 consist of metal or a metalized plastic material.

Further, in the shown embodiment the insulating body 41 is freely rotatable by more that 360°.

In the case a bayonet connection is provided at the first and second connector the required angle of rotation could be smaller than 360° according to the size of the rotary angle required by the bayonet connection.

The invention claimed is:

1. A terminated plug connector comprising:

a terminated plug connector housing;

mounting means formed integrally with the connector housing for mounting the terminated plug connector to a female connector; and an insulating body supported in a said terminated plug connector housing and adapted to support contact prongs which are adapted to be brought into engagement with contact elements of a female connector insulating body; and wherein the terminated plug connector housing forms an opening which comprises a groove providing for an axial mounting or fixation of the terminated plug connector insulating body.

2. The terminated plug connector of claim 1 wherein the terminated plug connector housing is a single piece, i.e. does not comprise a separate locking nut.

3. A terminated plug connector according to claim 1 wherein a reduced diameter section of the terminated plug connector housing extends toward the open end of the plug connector housing.

4. A terminated plug connector according to claim 1 wherein the groove comprises a mounting or detent surface and wherein the opening further comprises an abutment surface which cooperates with an annular abutment surface to rotatably support the terminated plug connector insulating body within the terminated plug connector housing while at the same time a small axial movement is allowed.

5. A terminated plug connector according to claim 1 wherein the terminated plug connector housing is preferably formed as a single piece and is terminated by a wall located opposite to a plug side.

6. A terminated plug connector according to claim 1 wherein the insulating body is freely rotatable within the terminated plug connector housing when mounting the terminated plug connector housing at the counter connector housing of the female connector due to a screw connection.

7. A terminated plug connector according to claim 1 wherein when mounting the terminated plug connector housing by means of bayonet means formed at the terminated plug connector housing and at the female connector housing, the insulating body is rotatably mounted to a degree which is required to obtain secure mounting of the bayonet means.

8. A terminated plug connector according to claim 1 wherein the contact prongs in the insulating body of the terminated plug connector are in connect to a terminating circuit, for instance a terminating resistor.

9. The terminated plug connector of claim 1 wherein the mounting means are formed by a threading which can be thread onto a threading provided at a housing of the female connector.

10. A terminated plug connector of claim 9 wherein the threading of the terminated plug connector housing is an outer threading which can be brought in engagement with an inner threading of the housing of the female connector.

11. A terminated plug connector according to claim 1 wherein the insulating body comprises a coding rib extending in a plug direction, said insulating body further comprising detent or mounting hooks extending in the opposite direction.

12. A terminated plug connector according to claim 11 wherein the mounting hooks are formed at the insulating body such that they can be resiliently moved radially inward.

13. A terminated plug connector according to claim 12 wherein the mounting hooks are circumferentially spaced apart.

14. A terminated plug connector comprising:

a terminated plug connector housing;

mounting means formed integrally with said connector housing for mounting said terminated plug connector to a female connector, said mounting means are formed by a threading which can be thread onto a threading provided at a housing of said female connector, wherein said threading of said terminated plug connector housing is an outer threading which can be brought in engagement with an inner threading of said housing of said female connector; and an insulating body supported in said terminated plug connector housing and adapted to support contact prongs which are adapted to be brought into engagement with contact elements of a female connector insulating body.

15. A terminated plug connector comprising:

a terminated plug connector housing;

mounting means formed integrally with said connector housing for mounting said terminated plug connector to a female connector; and an insulating body supported in a said terminated plug connector housing and adapted to support contact prongs which are adapted to be brought into engagement with contact elements of a female connector insulating body, and said insulating body being freely rotatable within said terminated plug connector housing when mounting said terminated plug connector housing at a counter connector housing of said female connector due to a screw connection.

* * * * *